US008072396B2

(12) United States Patent
Kitazawa et al.

(10) Patent No.: US 8,072,396 B2
(45) Date of Patent: Dec. 6, 2011

(54) UNIT CIRCUIT, ELECTRO-OPTICAL DEVICE, AND ELECTRONIC APPARATUS

(75) Inventors: Takayuki Kitazawa, Suwa (JP); Eiji Kanda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 921 days.

(21) Appl. No.: 11/749,907

(22) Filed: May 17, 2007

(65) Prior Publication Data

US 2007/0273619 A1 Nov. 29, 2007

(30) Foreign Application Priority Data

May 29, 2006 (JP) ..... 2006-147741

(51) Int. Cl.
*G09G 3/30* (2006.01)
*G09G 3/10* (2006.01)

(52) U.S. Cl. ..... 345/76; 315/169.3; 315/82; 315/204

(58) Field of Classification Search ..... 345/76–83, 345/204–215; 315/169.3, 169.1–169.4
See application file for complete search history.

(56) References Cited

U.S. PATENT DOCUMENTS

| | | | | |
|---|---|---|---|---|
| 2002/0089496 | A1* | 7/2002 | Numao | 345/204 |
| 2005/0237283 | A1 | 10/2005 | Ozawa et al. | |
| 2006/0103322 | A1* | 5/2006 | Chung et al. | 315/169.3 |
| 2006/0132055 | A1* | 6/2006 | Kwak | 315/169.3 |
| 2007/0024543 | A1* | 2/2007 | Chung et al. | 345/76 |

FOREIGN PATENT DOCUMENTS

| | | | |
|---|---|---|---|
| JP | 2004-133240 | A | 4/2004 |
| JP | A-2006-038965 | | 2/2006 |
| WO | WO 2004/066249 | A1 | 8/2004 |
| WO | WO 2004/109640 | A1 | 12/2004 |

* cited by examiner

*Primary Examiner* — Lun-Yi Lao
*Assistant Examiner* — Kenneth Bukowski
(74) *Attorney, Agent, or Firm* — Oliff & Berridge, PLC

(57) ABSTRACT

A unit circuit includes an electro-optical element, a first capacitive element, a second capacitive element, a third capacitive element, a drive transistor, a first switching element, an initialization unit, and a compensation unit. The electro-optical element emits an amount of light in accordance with a magnitude of a drive current. The first capacitive element includes a first electrode and a second electrode, the first electrode is electrically connected to a first node, and the second electrode is capable of receiving a fixed potential. The second capacitive element includes a third electrode and a fourth electrode, the third electrode is electrically connected to a second node, and the fourth electrode is capable of receiving a fixed potential. The third capacitive element includes a fifth electrode and a sixth electrode, the fifth electrode is electrically connected to the first node, and the sixth electrode is electrically connected to the second node. The drive transistor includes a gate, a source, and a drain and outputs the drive current in a driving period. The gate thereof is electrically connected to the second node. In a data writing period, the first switching element is in an on state and supplies to the first node a data potential supplied via a data line. The initialization unit causes the third capacitive element to discharge charges stored therein in an initialization period. The compensation unit electrically connects the source and the drain of the drive transistor together in a compensation period.

11 Claims, 12 Drawing Sheets

■ DATA WRITING PERIOD P2

■ DRIVING PERIOD P3

UNIT CIRCUIT, ELECTRO-OPTICAL DEVICE, AND ELECTRONIC APPARATUS

CROSS-REFERENCE TO RELATED APPLICATION

This application claims priority from Japanese Patent Application No. 2006-147741 filed in the Japanese Patent Office on May 29, 2006, the entire disclosure of which is hereby incorporated by reference in its entirety.

BACKGROUND

1. Technical Field

Embodiments of the present invention relate to a unit circuit that includes an electro-optical element, such as an organic light emitting diode (hereinafter referred to sometimes as OLED), an electro-optical device, and an electronic apparatus.

2. Related Art

Display devices that use an organic light emitting diode are becoming popular. One such display device includes a plurality of pixels. Each of the pixels has an organic light emitting diode and a transistor that drives the OLED. To obtain a stable uniform display state in a plane, it is necessary to cause the organic light emitting diodes in the pixels to emit the same amount of light. However, characteristics vary among transistors, and this results in a non-uniform display state for each pixel. With the aim of solving such a problem, JP-A-2004-133240 discloses a structure that reduces an error of a threshold voltage in a drive transistor.

FIG. 14 is a circuit diagram illustrating the structure disclosed in this patent document. In the structure, first, a drive transistor Tdr is diode-connected via a transistor TrA, thereby enabling the potential of a gate (node Z2) of the drive transistor Tdr to be set at a potential (Ve1−Vth) corresponding to a threshold voltage Vth therein. This potential is held by a capacitive element Cx. Second, a data line L is electrically connected to a node Z1 of a capacitive element Cy via a transistor TrB, thereby enabling a potential of the node Z1 (gate potential of the drive transistor Tdr) to be changed with a potential Vdata of the data line L. Due to the above-described operation, the gate potential of the drive transistor Tdr varies by a level corresponding to the amount of change in the potential of the node Z1, and a supply of a current Ie1 (current that does not depend on the threshold voltage Vth) corresponding to the varied potential drives an OLED element E.

In known structures, a capacitance between a drain and a source in the transistor TrB produces capacitive coupling between the data line 1, and the node Z1, and the arrangement of elements produces capacitive coupling between the data line L and the node Z2. Therefore, if the potential of the data line L is changed by parasitic capacitors C4 and C5, the gate potential of the drive transistor Tdr undesirably varies. Crosstalk produced by such capacitive coupling is a problem for not only a single unit circuit but also between that circuit and a data line for an adjacent unit circuit.

Additionally, for known structures, since both compensation for variations in a threshold voltage and data writing are performed within a single horizontal scan period, it is difficult to obtain a sufficient period of time required for the compensation for variations in the threshold voltage. If sufficient time is spent in compensating variations in the threshold voltage, it will be difficult to accurately write data.

SUMMARY

Some exemplary embodiments of the invention avoid crosstalk. Some embodiments accurately compensate variations in threshold voltage in a drive transistor and reliably writes a data voltage.

A unit circuit according to a first exemplary embodiment includes an electro-optical element, a first capacitive element, a second capacitive element, a third capacitive element, a drive transistor, a first switching element, an initialization unit, and a compensation unit. The electro-optical element emits an amount of light in accordance with a magnitude of a drive current. The first capacitive element includes a first electrode (for example, an electrode Ea1 illustrated in FIG. 2) and a second electrode (for example, an electrode Ea2 illustrated in FIG. 2). The first electrode is electrically connected to a first node, and the second electrode is capable of receiving a fixed potential. The second capacitive element includes a third electrode (for example, an electrode Eb1 illustrated in FIG. 2) and a fourth electrode (for example, an electrode Eb2 illustrated in FIG. 2). The third electrode is electrically connected to a second node, and the fourth electrode is capable of receiving a fixed potential. The third capacitive element includes a fifth electrode (for example, an electrode Ec1 illustrated in FIG. 2) and a sixth electrode (for example, an electrode Ec2 illustrated in FIG. 2). The fifth electrode is electrically connected to the first node, and the sixth electrode is electrically connected to the second node. The drive transistor includes a gate, a source, and a drain and outputs the drive current in a driving period. The gate thereof is electrically connected to the second node. In a data writing period, the first switching element (for example, a transistor Tr1 illustrated in FIG. 2) is in an on state and supplies to the first node a data potential supplied via a data line. The initialization unit (for example, transistors Tr2 to Tr4 illustrated in FIG. 2) causes the third capacitive element to discharge charges stored therein in an initialization period. The compensation unit (for example, a transistor Tr3 illustrated in FIG. 2) electrically connects the source and the drain of the drive transistor together in a compensation period.

In accordance with the unit circuit described above, the first to third capacitive elements are connected in a "pi " configuration. Therefore, providing a capacitor between a node that should hold a potential and a pixel power supply Ve1 enables a unit circuit to be relatively immune to the effects of crosstalk even when the potential of the data line varies. Moreover, since it is not necessarily required that both a compensation period and a data writing period are completed in a single horizontal scan period, a compensation operation can be performed over a plurality of horizontal scan periods. Therefore, variations in the threshold voltage can be accurately compensated, and data can be reliably written.

In the unit circuit described above, it is preferable that, in the initialization period, the initialization unit cause the third capacitive element to discharge charges stored therein and supply an initialization potential to the second node. This enables the potential of the second node to be set at the initialization potential, thereby reliably compensating variations in the threshold voltage. That is, it is preferable that the initialization potential be set such that the voltage between the gate and source of the drive transistor is at or above the threshold voltage.

As one specific form for the initialization unit, it is preferable that the initialization unit include a second switching element (for example, a transistor Tr2 illustrated in FIG. 2) disposed between the first node and a potential line that supplies the initialization potential, a third switching element (for example, a transistor Tr3 illustrated in FIG. 2) that has a first input terminal and a second input terminal, the first input terminal electrically connected to the second node, and a fourth switching element (for example, a transistor Tr4 illustrated in FIG. 2) disposed between the potential line and the second input terminal of the third switching element. In this case, when the second to fourth switching elements are set in the on state, a short circuit can occur in the fifth and sixth electrodes of the third capacitive element and charges stored therein can be discharged, while at the same time the potential of the gate (second node) of the drive transistor can be set at the initialization potential.

As another specific form for the initialization unit, it is preferable that the initialization unit include a second switching element that has a first input terminal and a second input terminal, the first input terminal electrically connected to a potential line that supplies the initialization potential, a third switching element that has a first input terminal and a second input terminal, the first input terminal electrically connected to the second node, and a fourth switching element disposed between the second input terminal of the second switching element and the second input terminal of the third switching element. Also in this case, a short circuit can occur in the fifth and sixth electrodes of the third capacitive element and charges stored therein can be discharged, while at the same time the potential of the gate (second node) of the drive transistor can be set at the initialization potential.

Additionally, it is preferable that the second input terminal of the third switching element in the initialization unit be electrically connected to the drain of the drive transistor, and, in the compensation period, the third switching element be in an on state and also functions as the compensation unit. In this case, setting the third switching element to be in the on state enables the drive transistor to be diode-connected.

It is preferable that the unit circuit described above further include a power supply line that supplies a power supply potential, and the power supply line be electrically connected to the source of the drive transistor, the second electrode of the first capacitive element, and the fourth electrode of the second capacitive element. In this case, since a single power supply line supplies a power to the drive transistor and the potential of each of the first capacitive element and the second capacitive element is fixed, the structure can be simplified.

It is preferable that the unit circuit described above further include a light-emission control switching element (for example, a light-emission control transistor Te1 illustrated in FIG. 2) disposed on an electrical path between the drive transistor and the electro-optical element, the light-emission control switching element be in an on state in the driving period and be in an off state in the initialization period, the compensation period, and the data writing period. In this case, since the drive current is not supplied to the electro-optical element except for a driving period, low gray scale levels can be precisely represented, and thus an artifact where should be true black, which is a phenomenon that displays a grayish portion that should have been displayed black, can be avoided.

In the unit circuit described above, it is preferable that the first capacitive element, the second capacitive element, and the third capacitive element have substantially the same capacitance value. In this case, a maximum total capacitance can be achieved, and therefore, the effects of crosstalk can be further reduced.

An electro-optical device according to a second exemplary embodiment includes a plurality of unit circuits. Each of the unit circuits includes an electro-optical element, a first capacitive element, a second capacitive element, a third capacitive element, a drive transistor, a first switching element, an initialization unit, and a compensation unit. The electro-optical element emits an amount of light in accordance with a magnitude of a drive current. The first capacitive element includes a first electrode and a second electrode, the first electrode is electrically connected to a first node, and the second electrode is capable of receiving a fixed potential. The second capacitive element includes a third electrode and a fourth electrode, the third electrode is electrically connected to a second node, and the fourth electrode is capable of receiving a fixed potential. The third capacitive element includes a fifth electrode and a sixth electrode, the fifth electrode is electrically connected to the first node, and the sixth electrode is electrically connected to the second node. The drive transistor includes a gate, a source, and a drain and outputs the drive current in a driving period. The gate thereof is electrically connected to the second node. In a data writing period, the first switching element is in an on state and supplies to the first node a data potential supplied via a data line. The initialization unit causes the third capacitive element to discharge charges stored therein in an initialization period. The compensation unit electrically connects the source and the drain of the drive transistor together in a compensation period.

In accordance with some exemplary embodiments, the first to third capacitive elements are connected in a "pi" configuration. Therefore, providing a capacitor between a node that should hold a potential and a pixel power supply Ve1 enables a unit circuit to be relatively immune to the effects of crosstalk even when the potential of the data line varies. Moreover, since it is not necessarily required that both a compensation period and a data writing period are completed in a single horizontal scan period, a compensation operation can be performed over a plurality of horizontal scan periods. Therefore, variations in the threshold voltage can be accurately compensated, and data can be reliably written.

A typical example of the electro-optical device is a device that uses, as a driven element, an electro-optical element in which optical characteristics, such as luminance and transmittance, vary by an application of an electrical energy thereto, e.g., a light emitting device that uses a light emitting element as an electro-optical element.

An electro-optical device according to some exemplary embodiments is applicable to various electronic apparatuses. One typical example of the electronic apparatuses is an apparatus that uses an electro-optical device according to an exemplary embodiment as a display device. Examples of this type of electronic apparatus include a personal computer and a cellular phone. However, applications of an electronic apparatus according to an exemplary embodiment are not limited to image displaying. The electronic apparatus according to exemplary embodiments is applicable to other various apparatuses, such as an exposure apparatus (exposure head) for forming a latent image on an image bearing member (e.g., a photosensitive drum) by radiation of light beams and an illuminating apparatus, such as an apparatus disposed at the back of a liquid crystal device and used for illuminating the liquid crystal device (e.g., backlight) and an apparatus incorporated in an image reading device (e.g., scanner) and used for illuminating a document.

BRIEF DESCRIPTION OF THE DRAWINGS

Exemplary embodiments of the invention will be described with reference to the accompanying drawings, wherein like numbers reference like elements.

DESCRIPTION OF EXEMPLARY EMBODIMENTS

1. Embodiment

Figure 1:
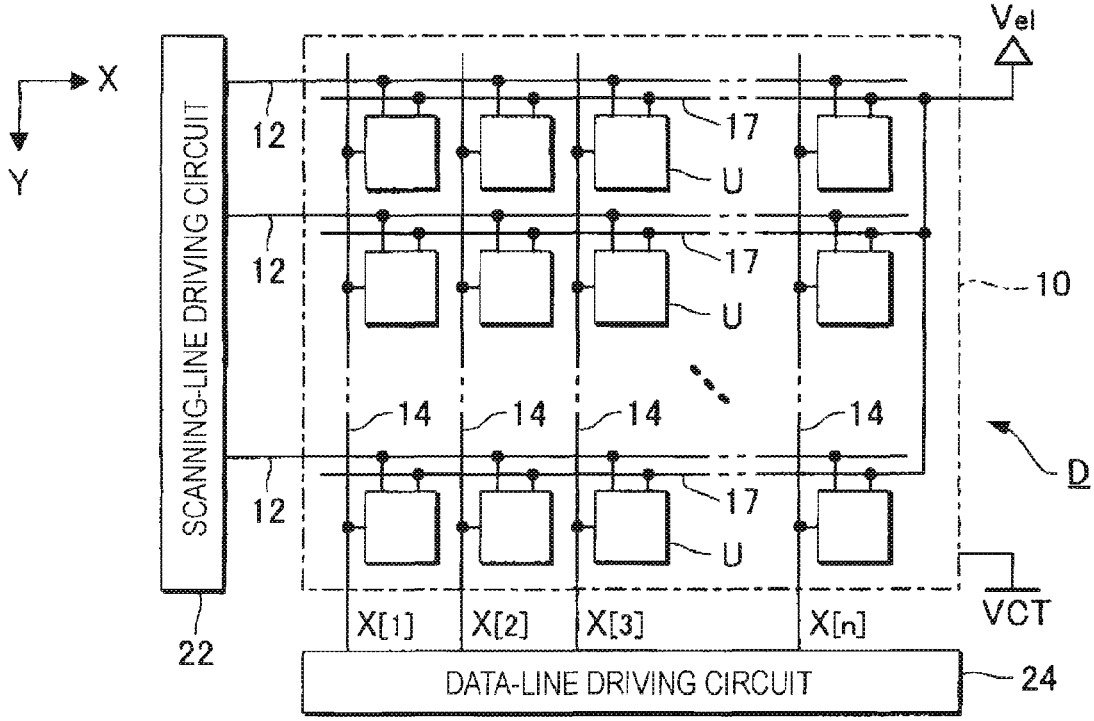
FIG. 1 is a block diagram illustrating the structure of an electronic device according to an embodiment of the invention.

FIG. 1 is a block diagram illustrating the structure of an electronic apparatus according to an embodiment of the invention. An electronic device D illustrated in FIG. 1 is an electro-optical device (light emitting device) incorporated as an image displaying unit in one of various kinds of electronic apparatuses. The electronic device D includes an element array 10 having a plurality of unit circuits (pixel circuits) U arranged in a generally planer configuration. The electronic device D also includes a scanning-line driving circuit 22 and a data-line driving circuit 24 for driving the unit circuits U. Each of the scanning-line driving circuit 22 and data-line driving circuit 24 may be constructed of a transistor formed together with the element array 10 on a substrate or may be implemented in the form of an IC chip.

As illustrated in FIG. 1, the element array 10 is provided with m scanning lines 12 extending in the X direction and n data lines 14 extending in the Y direction, which is perpendicular to the X direction (m and n are each a natural number). Each of the unit circuits U corresponds to an intersection of each of the scanning lines 12 and each of the data lines 14. Therefore, the unit circuits U are arranged in a matrix with m rows and n columns. A high power supply potential Ve1, which is at a higher side, is supplied to each of the unit circuits U via a power supply line 17.

The scanning-line driving circuit 22 is a circuit for successively selecting each of the plurality of scanning lines 12 in turn. The data-line driving circuit 24 generates data signals X[1 ] to X[n] corresponding to a single row of unit circuits U (i.e., n unit circuits U) connected to a scanning line 12 selected by the scanning-line driving circuit 22 and outputs the data signals to corresponding data lines 14. During a period when an i-th scanning line 12 (i is an integer that satisfies $1 \leqq i \leqq m$) is selected (a data writing period P2, which will be described below), a data signal X[j], which is supplied to a j-th data line 14 (j is an integer that satisfies $1 \leqq j \leqq n$), has a potential corresponding to a gray scale specified for a unit circuit U at the j-th column of the i-th row. The gray scale of each of the unit circuits U is specified by gray-scale data supplied from the exterior thereof.

Figure 2:
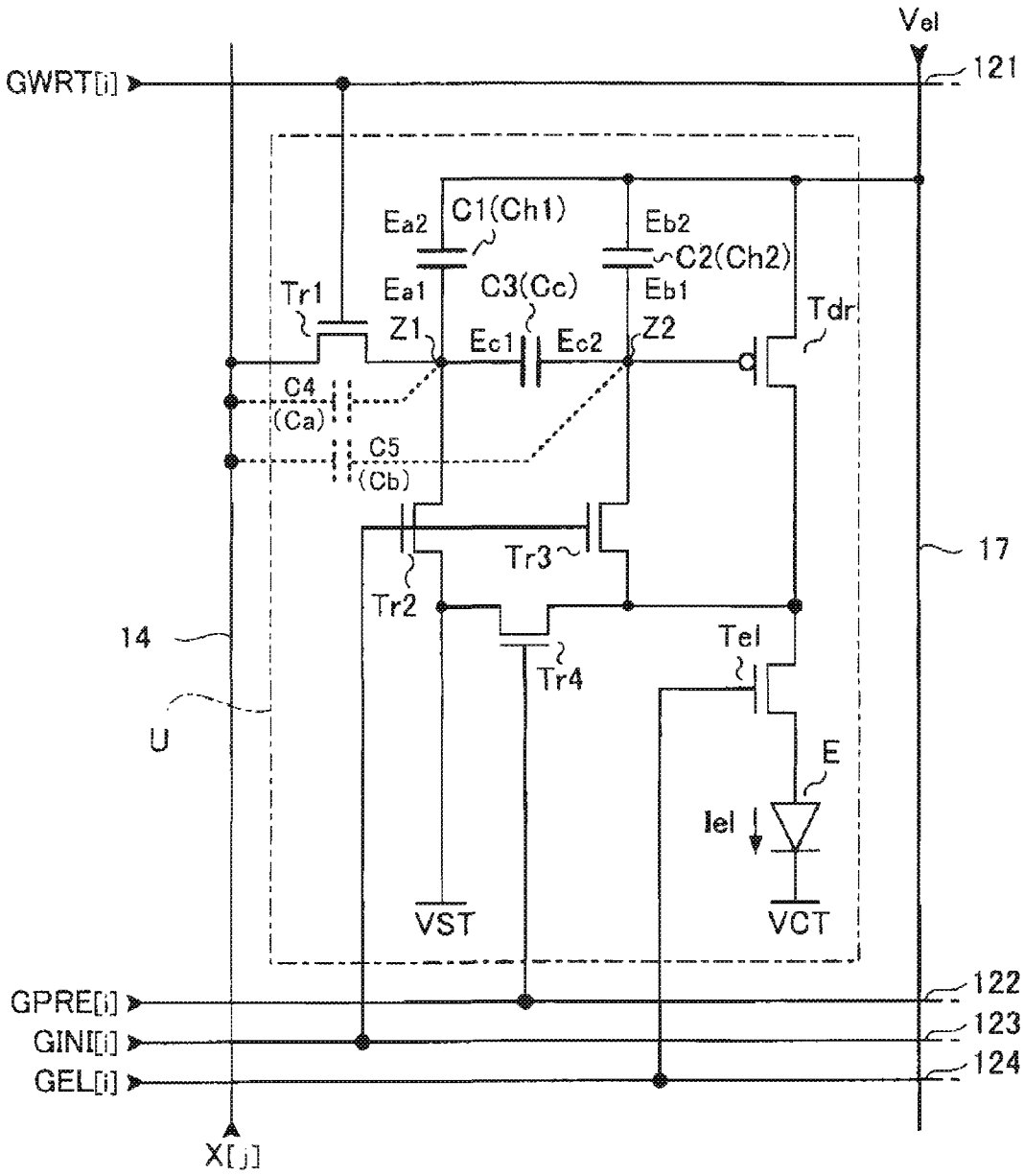
FIG. 2 is a circuit diagram illustrating the structure of a single unit circuit.

A specific structure of each unit circuit U will now be described with reference to FIG. 2. Since the unit circuits U have substantially the same structure, only one unit circuit U located in the j-th column of the i-th row is illustrated in FIG. 2. As illustrated in this drawing, the unit circuit U includes an electro-optical element E disposed between the power supply line 17 and a low supply potential VCT. The electro-optical element E is a current-driven element that has a gray scale (luminance) corresponding to a drive current Ie1 supplied thereto. The electro-optical element E according to the present embodiment is an OLED element (light emitting element) in which a light emitting layer made of an organic electroluminescent (EL) material is disposed between an anode and a cathode.

As illustrated in FIG. 2, the scanning line 12, which is illustrated in FIG. 1 as a single line for the sake of convenience, actually includes four leads of a first control line 121, a second control line 122, a third control line 123, and a fourth control line 124. A predetermined signal is supplied from the scanning-line driving circuit 22 to each of the control lines. More specifically, a scan signal GWRT[i] is supplied to the first control line 121 included in the i-th scanning line 12. Similarly, an initialization signal GPRE[i] is supplied to the second control line 122, a compensation control signal GINI [i] is supplied to the third control line 123, and a light-emission control signal GEL[i] is supplied to the fourth control line 124. A specific waveform of each of these signals and the operation of the unit circuit U associated therewith will be described below.

As illustrated in FIG. 2, a p-channel drive transistor Tdr is disposed on a path from the power supply line 17 to the anode of the electro-optical element E. A source (S) of the drive transistor Tdr is connected to the power supply line 17. The drive transistor Tdr is a unit that changes a conduction state between the source (S) and a drain (D) (resistance between the source and the drain) in response to a change in a potential of the gate (hereinafter referred to as gate potential), Vg, and thereby generates a drive current Ie1 corresponding to the gate potential Vg. That is, the electro-optical element E is driven in response to the conduction state of the drive transistor Tdr.

An n-channel transistor (hereinafter referred to as light-emission control transistor) Te1 that controls an electrical connection between the drain of the drive transistor Tdr and the anode of the electro-optical element E is disposed therebetween. A gate of the light-emission control transistor Te1 is connected to the fourth control line 124. Therefore, when the light-emission control signal GEL[i] is shifted to a high level, the light-emission control transistor Te1 is then changed to an on state. This enable the drive current Ie1 to be supplied to the electro-optical element E. In contrast, when the light-emission control signal GEL[i] is at a low level, the light-emission control transistor Te1 is maintained in an off state, so the path over which the drive current Ie1 is to flow is being interrupted and the electro-optical element E is in the off state.

As illustrated in FIG. 2, the unit circuit U according to the present embodiment includes three capacitive elements (C1, C2, and C3) and four n-channel transistors (Tr1, Tr2, Tr3, and Tr4). The first capacitive element C1 is an element that has an electrode Ea1, an electrode Ea2, and a dielectric disposed in a gap between the electrodes Ea1 and Ea2 and has a capacitance value Ch1. Similarly, the second capacitive element C2 is an element that has an electrode Eb1, an electrode Eb2, and a dielectric disposed in a gap between the electrodes Eb1 and Eb2 and has a capacitance value Ch2, and the third capacitive element C3 is an element that has an electrode Ec1, an electrode Ec2, and a dielectric disposed in a gap between the electrodes Ec1 and Ec2 and has a capacitance value Cc. The electrode Ea2 of the first capacitive element C1 and the electrode Eb2 of the second capacitive element C2 are connected to the power supply line 17. The electrode Ea1 of the first capacitive element C1 is connected to the electrode Ec1 of the third capacitive element C3. The electrode Eb1 of the second capacitive element C2 is connected to the electrode Ec2 of the third capacitive element C3.

The transistor Tr1 is a switching element disposed between a node Z1 (the electrode Ec1 of the third capacitive element C3) and the data line 14 and controlling an electrical connection therebetween. A gate of the transistor Tr1 is connected to the first control line 121 and receives the scan signal GWRT[i]. The transistor Tr4 is a switching element disposed between a potential line (not shown) to which an initialization potential VST is supplied and the drain of the transistor Tr4 and controlling an electrical connection therebetween. A gate of the transistor Tr4 is connected to the second control line 122 and receives the initialization signal GPRE[i]. The transistor Tr2 is a switching element disposed between the node Z1 and the potential line to which the initialization potential VST is supplied and controlling an electrical connection therebetween. A gate of the transistor Tr2 is connected to the third control line 123 and receives the compensation control signal GINI[i]. The transistor Tr3 is a switching element disposed between a node Z2 (the electrode Ec2 of the third capacitive element C3) and the drain of the transistor Tdr and controlling an electrical connection therebetween. A gate of the transistor Tr3 is connected to the third control line 123 and receives the compensation control signal GINI[i].

A specific waveform of each of the signals used in the electronic device D will now be described with reference to FIG. 3. As illustrated in this drawing, scan signals GWRT[1] to GWRF[m] are successively shifted to a high level for each predetermined period (hereinafter referred to as data writing period) P2 within each frame period F. That is, the scan signal GWRT[i] is maintained at a high level in an i-th data writing period P2 within one frame period F and maintained at a low level in the other periods within the frame period F. The transition of the scan signal GWRT[i] to a high level indicates that the i-th row is selected.

Figure 3:
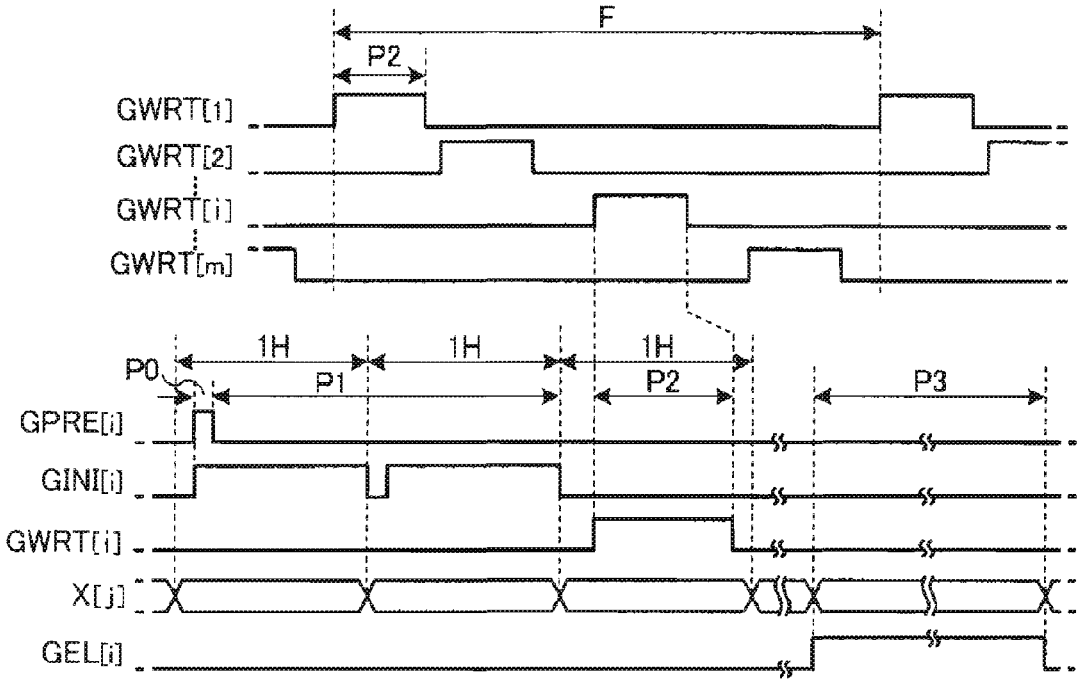
FIG. 3 is a timing diagram for describing the operation of the electronic device.

As illustrated in FIG. 3, in a compensation period P1 prior to a first horizontal scan period 1H at which the scan signal GWRT[i] is at a high level (in this example, in two immediately preceding horizontal scan periods 1H), the compensation control signal GINI[i] is at a high level. In the compensation period P1, the threshold voltage Vth in the drive transistor Tdr is electrically charged by the second capacitive element C2. In this example, an initialization period P0 is assigned to a predetermined period before the start of the compensation period P1. The data writing period P2 is a period used for causing the second capacitive element C2 to hold the Vdata corresponding to a gray scale specified for a unit circuit U in responsive to gray-scale data supplied from the exterior In a driving period P3, the electro-optical element E is driven on the basis of the voltage held by the second capacitive element C2. Operations in the unit circuit U located in the j-th column of the i-th row will now be described below in greater detail with reference to FIGS. 4 to 7 for each of the initialization period P0, the compensation period P1, the data writing period P2, and the driving period P3.

(A) Initialization Period P0

Figure 4:
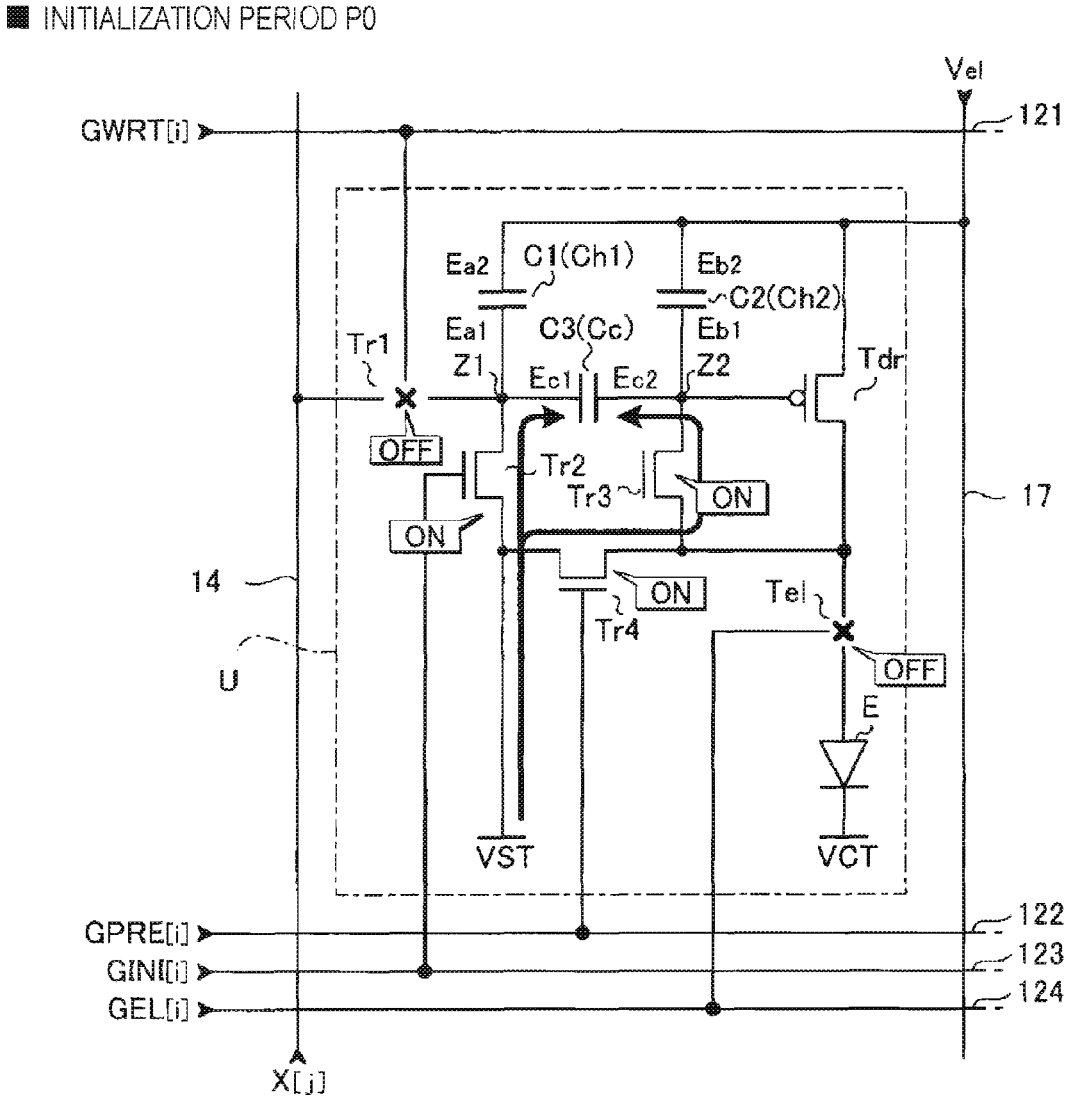
FIG. 4 is a circuit diagram illustrating a status of the unit circuit in an initialization period.

FIG. 4 illustrates a status of the unit circuit U in an initialization period P0 where the initialization signal GPRE[i] is at a high level. In this status, the initialization signal GPRE[i] and the compensation control signal GINI[i] are at a high level, and therefore the transistor Tr2, the transistor Tr3, and the transistor Tr4 are in the on state. As a result, electrical charges stored in the electrodes Ec1 and Ec2 of the third capacitive element C3 are discharged, and the potential thereof is set at the initialization potential VST. During the initialization period P0, the scan signal GWRT[i] and the light-emission control signal GEL[i] are at a low level, and the transistor Tr1 and the light-emission control transistor Te1 are in the off state.

(B) Compensation Period P1

Figure 5:
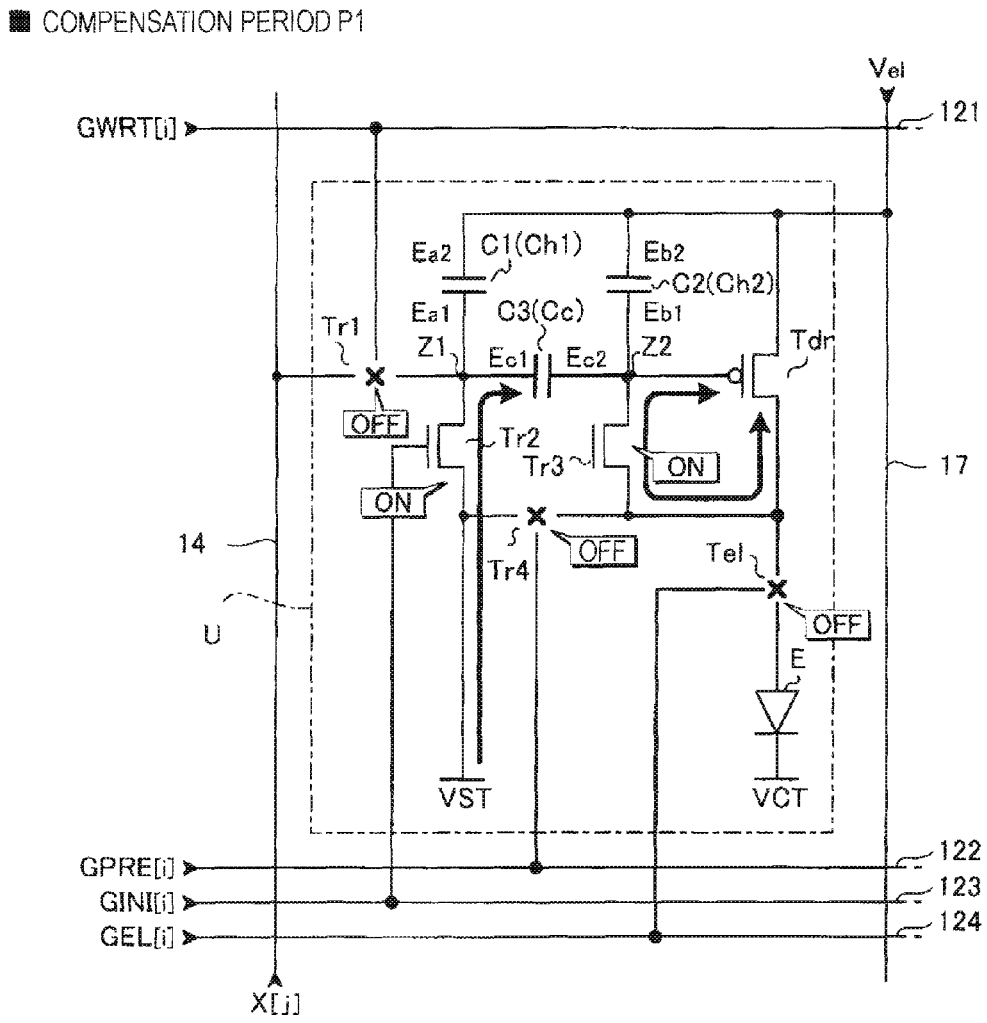
FIG. 5 is a circuit diagram illustrating a status of the unit circuit in a compensation period.

FIG. 5 illustrates a status of the unit circuit U in a compensation period P1. In this state, the initialization signal GPRE[i] is shifted from a high level to a low level, whereas the compensation control signal GINI[i] is at a high level. Therefore, the transistor Tr4 is shifted from the on state to the off state, and the transistor Tr2 and the transistor Tr3 are maintained in the on state. At this time, the potential of the electrode Ec1 of the third capacitive element C3 is fixed at the initialization potential VST, and the drive transistor Tdr is diode-connected. A current flows from the source to the drain in the drive transistor Tdr. This causes the voltage between the gate and the source in the drive transistor Tdr to become asymptotic to the threshold voltage Vth, and therefore, the gate potential Vg of the drive transistor Tdr converges to a value of "Ve1−Vth". The second capacitive element C2 holds the threshold voltage Vth. If the compensation period P1 is short, the gate potential Vg cannot converge to a value of "Ve1−Vth". In the present embodiment, since the data writing period P2 and the initialization period P0 can be independently set, it is not necessary to have both in a single horizontal scan period 1H. Accordingly, the compensation period P1 can be set in a horizontal scan period different from that in which the data writing period P2 is set. In this example, as illustrated in FIG. 3, one compensation period P1 is set across a boundary between two consecutive horizontal scan periods. As a result, variations in the threshold voltage Vth can be sufficiently compensated.

The initialization potential VST is set at a potential smaller than a value of "Ve1−Vth". Therefore, at the time of starting a compensation operation, the gate potential Vg of the drive transistor Tdr is sufficiently low. Thus, it is not necessary to decrease the gate potential Vg by feeding a current through the electro-optical element E. In the compensation period P1, a low-level light-emission control signal GEL[i] maintains the off state of the light-emission control transistor Te1, and the drive current Ie1 is not supplied to the electro-optical element E. If the drive current Ie1 is fed through the electro-optical element E to decrease the gate potential Vg, a grayish display would appear when a black display should have appeared, thus resulting in degraded image quality. In contrast to this, in the present embodiment, since the initialization potential VST is supplied, the image quality in display can be improved.

(C) Data Writhing Period P2

Figure 6:
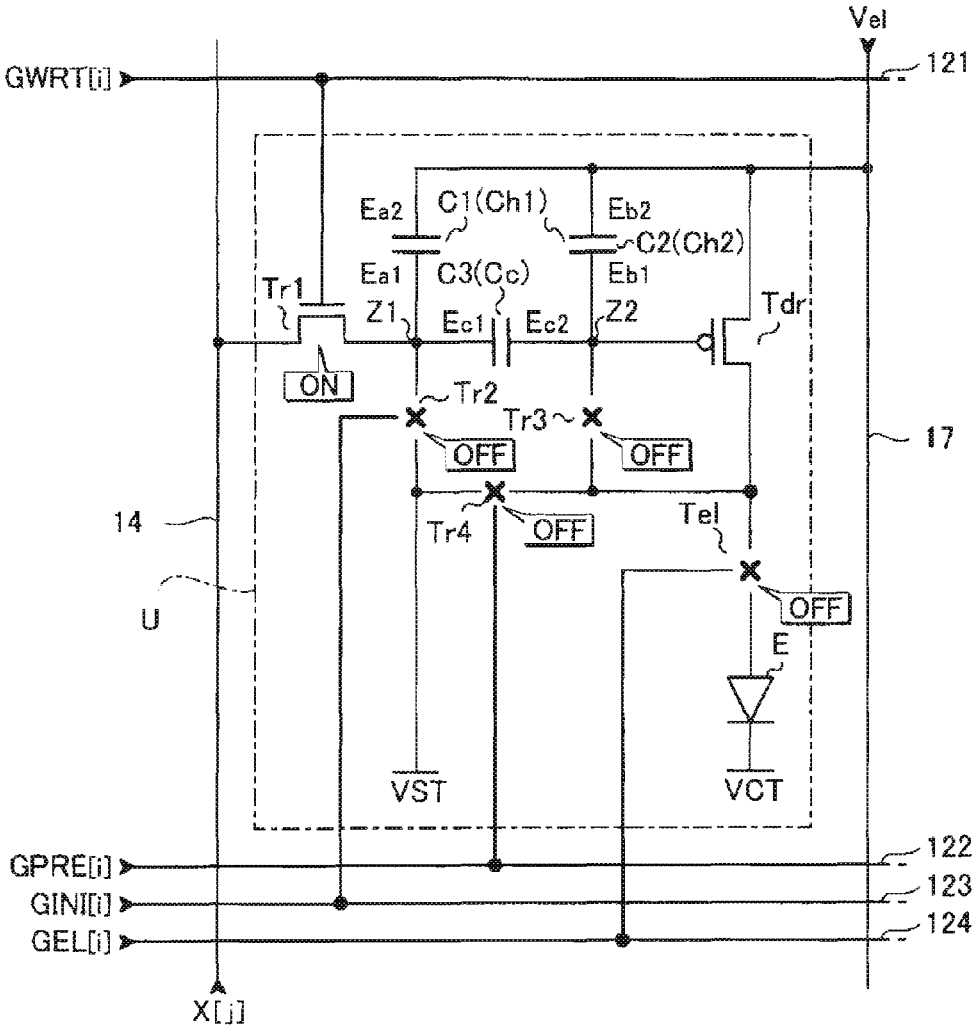
FIG. 6 is a circuit diagram illustrating a status of the unit circuit in a data writing period.

FIG. 6 illustrates a status of the unit circuit U in a data writing period P2 where the scan signal GWRT[i] is at a high level. In the data writing period P2, the transistor Tr1 is changed to the on state, the transistors Tr2 and Tr3 are changed to the off state, and the transistor Tr4 and the light-emission control transistor Te1 are maintained in the off state. In this status, the electrode Ec1 of the third capacitive element C3 is electrically connected to the data line 14. At this time, a potential of VST−α·Vdata is supplied as a data signal X[j] to the data line 14. As a result, the potential of the electrode Ec1 of the third capacitive element C3 is changed from the initialization potential VST to the potential VST−α·Vdata. This amount of change ΔV1 is given by the following expression (1):

$$\Delta V1=-\alpha\cdot V\text{data} \tag{1}$$

where α is a coefficient and α=(Cc+Ch2)/Ch2.

Since the third capacitive element C3 functions as a coupling capacitor, the gate potential Vg of the drive transistor Tdr is changed by a voltage calculated by dividing ΔV1 by a capacitance ratio of the second capacitive element C2 and the third capacitive element C3. This amount of change ΔV2 is given by the following expression (2):

$$\Delta V2=\Delta V1\cdot Ch2/(Cc+Ch2)=-V\text{data} \tag{2}$$

Furthermore, since the gate potential Vg at the end of the initialization period P0 is Ve1−Vth, the gate potential Vg at the end of the data writing period P2 is given by the following expression (3):

$$Vg=Ve1-Vth+\Delta V2=Ve1-Vth-V\text{data} \tag{3}$$

(D) Driving Period P3

Figure 7:
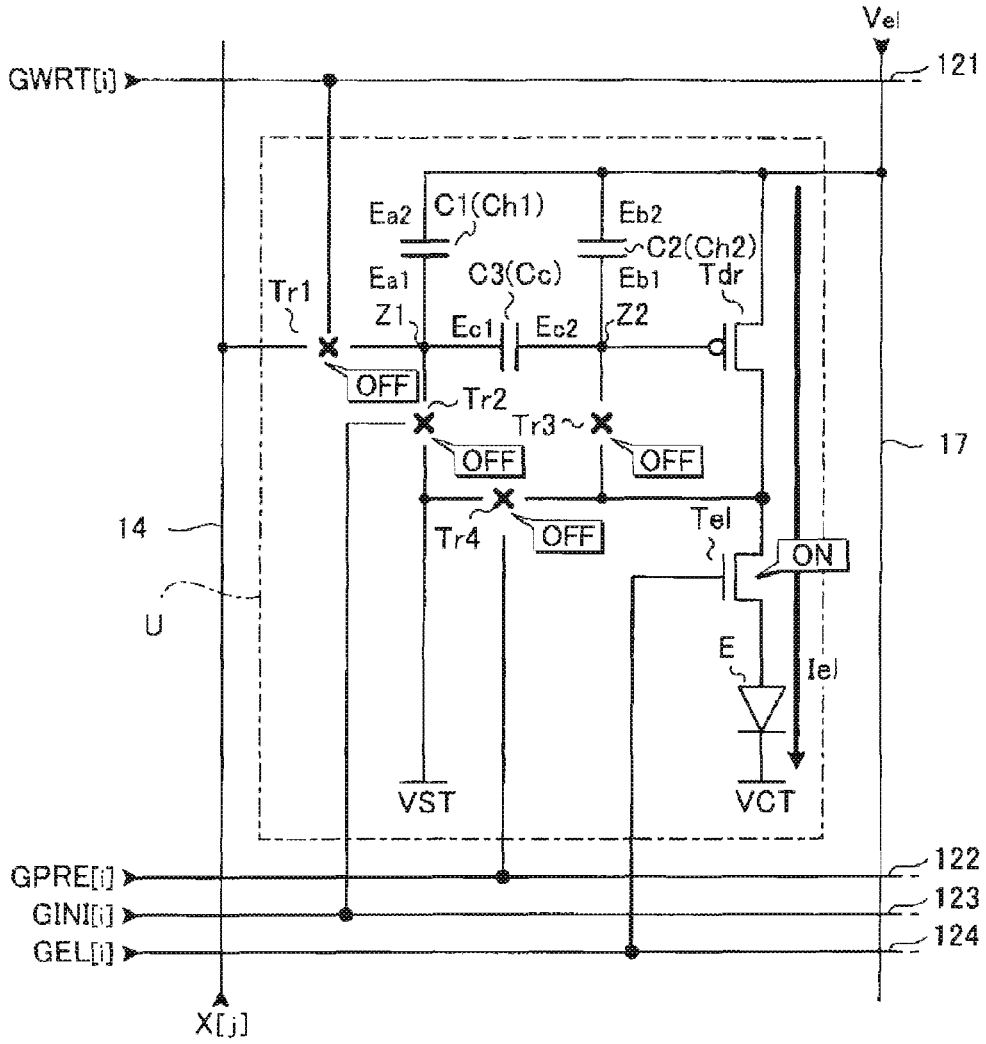
FIG. 7 is a circuit diagram illustrating a status of the unit circuit in a driving period.

FIG. 7 illustrates a status of the unit circuit U in a driving period P3. In this status, the scan signal GWRT[i], the initialization signal GPRE[i], and the compensation control signal GINI[i] are at a low level. Therefore, the transistor Tr1 is changed to the off state, and the electrode Ec1 of the third capacitive Cement C3 is electrically isolated from the data line 14. The transistors Tr2, Tr3, and Tr4 are in the off state. In this driving period P3, the light-emission control signal GEL[i] is at a high level, the light-emission control transistor Te1 is changed to the on state. At this time, the drive current Ie1 according to the magnitude of the gate potential Vg is supplied from the drive transistor Tdr to the electro-optical element E. If it is assumed that the drive transistor Tdr operates in the saturation region, the drive current Ie1 is a current value represented by the following expression (4):

$$Ie1=(\beta/2)(Vgs-Vth)^2 \tag{4}$$

where β is a gain factor of the drive transistor Tdr.

Since the source of the drive transistor Tdr is connected to the power supply line 17, the voltage Vgs in expression (4) is a difference between the gate potential Vg and the high power supply potential Ve1 (i.e., Vgs=Ve1−Vg). In the driving period P3, since the gate potential Vg is given by expression (3), expression (4) is changed to the following expression (5):

$$Ie1=(\beta/2)\{Ve1-(Ve1-Vth-V\text{data})-Vth\}^2=(\beta/2)(V\text{data})^2 \tag{5}$$

As is understood from expression (5), the drive current Ie1 is determined by the potential Vdata and does not depend on the threshold voltage Vth in the transistor Tdr. Therefore, variations in the threshold voltage Vth in the drive transistor Tdr in each unit circuit U can be compensated, and thus non-uniformity in gray scale (luminance) in the electro-optical elements E can be suppressed.

As described above, in the present embodiment, the compensation period P1 and the data writing period P2 can be set in different horizontal scan periods. Therefore, each of the compensation period P1 and the data writing period P2 can be a long time period. As a result, variations in the threshold voltage Vth can be accurately compensated, and the voltage Vdata can be sufficiently written. Hence, non-uniformity in luminance can be reduced and precision in gray scale in display can be improved.

Figure 14:
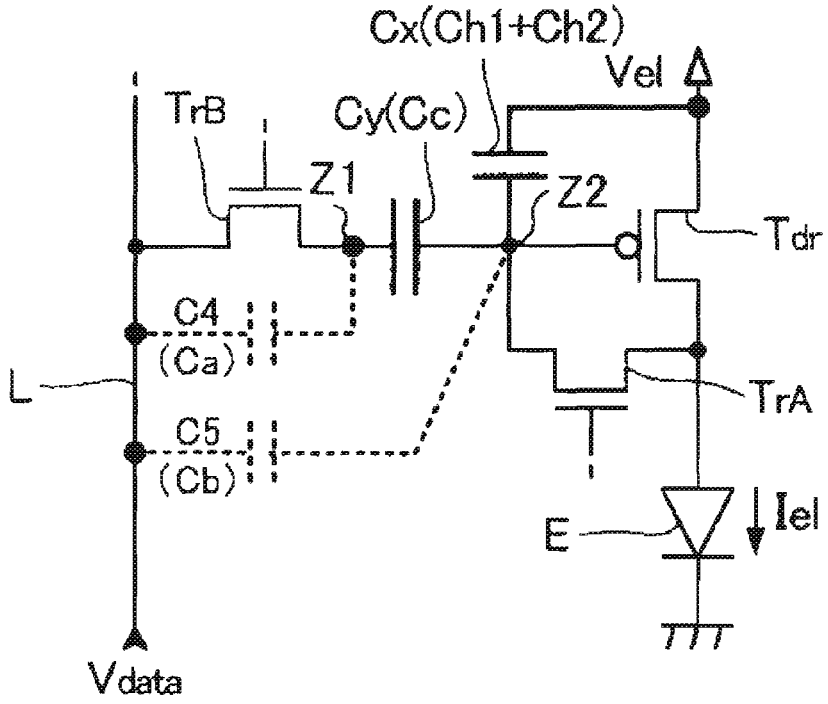
FIG. 14 is a circuit diagram illustrating the structure of a known unit circuit.

Next, to what extent the unit circuit U is affected by crosstalk between the data line 14 and each of the nodes in the unit circuit U will be described. As a comparative example, a known unit circuit illustrated in FIG. 14 is first discussed. In FIG. 14, the parasitic capacitor C4 occurs between the data line L and the node Z1 and has a capacitance value Ca. The parasitic capacitor Cs occurs between the data line L and the node Z2 and has a capacitance value Cb. When a varying amplitude of a potential of the data line 14 is Vamp and the amount of change in voltage for the gate potential of the drive transistor Tdr caused by the parasitic capacitor C4 is ΔVa, the voltage change ΔVa is divided by a capacitance ratio of Ca, Cc, and Ch1+Ch2. Therefore, the voltage change ΔVa is given by the following expression (6):

$$\Delta V_a=\frac{\dfrac{1}{C_{h1}+C_{h2}}}{\dfrac{1}{C_a}+\dfrac{1}{C_c}+\dfrac{1}{C_{h1}+C_{h2}}}\cdot V_{amp}=\frac{C_a\cdot C_c}{C_a\cdot(C_{h1}+C_{h2})+C_c\cdot(C_{h1}+C_{h2})+C_a\cdot C_c}\cdot V_{amp} \tag{6}$$

When Ca is significantly smaller than Cc, Ch1, and Ch2, expression (6) can be changed into the following expression (7):

$$\Delta V_a\approx\frac{C_a}{C_{h1}+C_{h2}}\cdot V_{amp} \tag{7}$$

Similarly, when the amount of change in voltage for the gate potential of the drive transistor Tdr caused by the parasitic capacitor C5 is ΔVb, the voltage change ΔVb is divided by a capacitance ratio of Cb and Ch1+Ch2. Therefore, the voltage change ΔVb is given by the following expression (8):

$$\Delta V_b=\frac{\dfrac{1}{C_{h1}+C_{h2}}}{\dfrac{1}{C_b}+\dfrac{1}{C_{h1}+C_{h2}}}\cdot V_{amp}=\frac{C_b}{C_{h1}+C_{h2}+C_b}\cdot V_{amp} \tag{8}$$

When Cb is significantly smaller than Ch1 and Ch2, expression (8) can be changed into the following expression (9):

$$\Delta V_b\approx\frac{C_b}{C_{h1}+C_{h2}}\cdot V_{amp} \tag{9}$$

At this time, when the amount of change in potential of the gate potential Vg of the drive transistor Tdr is ΔVg, the potential change ΔVg is given by the following expression (10):

$$\Delta V_g = \Delta V_a + \Delta V_b = \frac{C_a + C_b}{C_{h1} + C_{h2}} \cdot V_{amp} \tag{10}$$

Next, the present embodiment illustrated in FIG. 2 will now be discussed. When the amount of change in voltage for the gate potential of the drive transistor Tdr caused by a parasitic capacitor C4 is ΔVa', the voltage change ΔVa' is divided by a capacitance ratio of Ca, Cc, and Ch1+Ch2. Therefore, the voltage change ΔVa' is given by the following expression (11):

$$\Delta V_a' = \frac{\dfrac{1}{C_{h1} + \dfrac{C_c \cdot C_{h2}}{C_c + C_{h2}}}}{\dfrac{1}{C_a} + \dfrac{1}{C_{h1} + \dfrac{C_c \cdot C_{h2}}{C_c + C_{h2}}}} \cdot \frac{\dfrac{1}{C_2}}{\dfrac{1}{C_c} + \dfrac{1}{C_2}} \cdot V_{amp} = \frac{C_a}{C_a + C_{h1} + \dfrac{C_c \cdot C_{h2}}{C_c + C_{h2}}} \cdot \frac{C_c}{C_c + C_{h2}} \cdot V_{amp} \tag{11}$$

When Ca is significantly smaller than Ch1, expression (11) can be changed into the following expression (12):

$$\Delta V_a' \approx \frac{C_a}{C_{h1} + \dfrac{C_c \cdot C_{h2}}{C_c + C_{h2}}} \cdot \frac{C_c}{C_c + C_{h2}} \cdot V_{amp} = \frac{C_a \cdot C_c}{C_{h1} \cdot C_{h2} + C_c \cdot (C_{h1} + C_{h2})} \cdot V_{amp} \tag{12}$$

Similarly, when the amount of change in voltage for the gate potential of the drive transistor Tdr caused by a parasitic capacitor C5 is ΔVb', the voltage change ΔVb' is divided by a capacitance ratio of Cb, Cc, Ch1, and Ch2. Therefore, the voltage change ΔVb' is given by the following expression (13):

$$\Delta V_b' = \frac{\dfrac{1}{C_{h2} + \dfrac{C_c \cdot C_{h1}}{C_c + C_{h1}}}}{\dfrac{1}{C_b} + \dfrac{1}{C_{h2} + \dfrac{C_c \cdot C_{h1}}{C_c + C_{h1}}}} \cdot V_{amp} = \frac{C_b \cdot (C_c + C_{h1})}{C_{h1} \cdot C_{h2} + C_c \cdot (C_{h1} + C_{h2})} \cdot V_{amp} \tag{13}$$

At this time, when the amount of change in potential of the gate potential Vg of the drive transistor Tdr is ΔVg', the potential change ΔVg' is given by the following expression (14):

$$\Delta V_g' = \Delta V_a' + \Delta V_b' = \frac{C_a \cdot C_c + C_b \cdot (C_c + C_{h1})}{C_{h1} \cdot C_{h2} + C_c \cdot (C_{h1} + C_{h2})} \cdot V_{amp} \tag{14}$$

Next, a comparison of crosstalk between both cases will be described. When Cc=Ch1=Ch2=C, expressions (10) and (14) can be changed into the following expressions (15) and (16), respectively. Since substantially Ca=4Cb, depending on the arrangement of components in the unit circuit U, expressions (15) and (16) can be changed into the following expressions (17) and (18), respectively:

$$\Delta V_g = \frac{C_a + C_b}{2C} \cdot V_{amp} \tag{15}$$

$$\Delta V_g' = \frac{C_a + 2C_b}{3C} \cdot V_{amp} \tag{16}$$

$$\Delta V_g = \frac{5C_a}{8C} \cdot V_{amp} \tag{17}$$

$$\Delta V_g' = \frac{C_a}{2C} \cdot V_{amp} \tag{18}$$

A comparison of expressions (17) and (18) shows that the effects of crosstalk in the unit circuit U illustrated in FIG. 2 according to the present embodiment is reduced to approximately one-third of the effects thereof illustrated in FIG. 14. Therefore, even when the potential of the data line 14 varies, the unit circuit U that is relatively immune to the effects of crosstalk can be provided.

As described above, connecting the first capacitive element C1 to the third capacitive element C3 in a "pi" configuration such that the first capacitive element C1 and the second capacitive element C2 are provided at the nodes Z1 and Z2, respectively, can reduce crosstalk caused by a capacitance Cds between the source and drain in the transistor Tr1. Additionally, setting the capacitance value Ch1 of the first capacitive element C1, the capacitance value Ch2 of the second capacitive element C2, and the capacitance value Ch3 of the third capacitive element C3 at substantially the same value can achieve the maximum magnitude of the total capacitance of each of the nodes Z1 and Z2. This can further reduce the effects of crosstalk.

The crosstalk described above deals with between a unit circuit U and a data line 14 that supplies a data potential to this unit circuit U. Although a similar problem occurs in between the unit circuit U and a data line 14 for an adjacent unit circuit U, the use of unit circuits U according to the present embodiment can similarly reduce crosstalk caused by the data line 14 for the adjacent unit circuit U.

2. Forms of Unit Circuit U

Various forms of the unit circuit U according to the above-described embodiment will now be described below.

(1) First Modification

Figure 8:
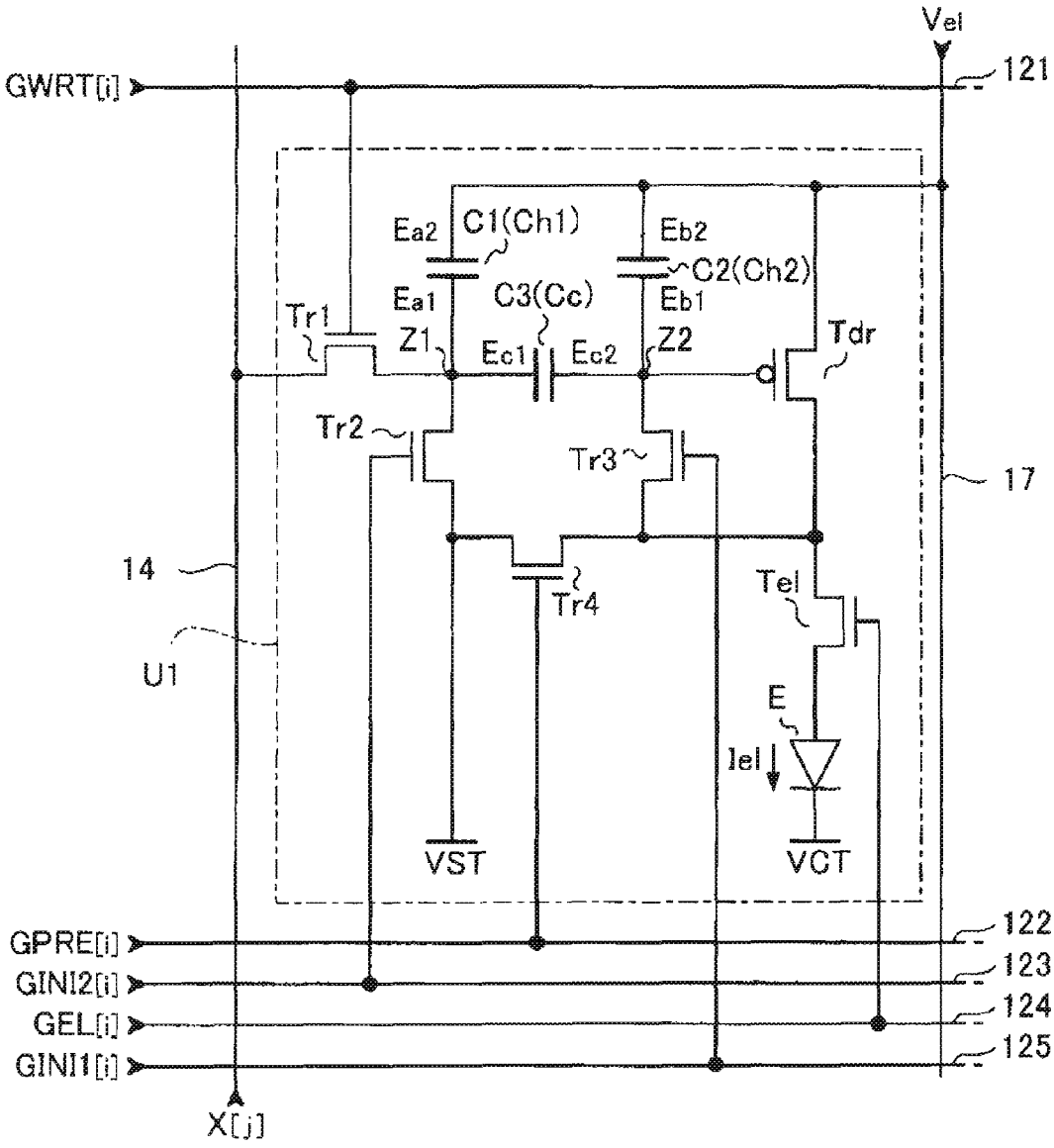
FIG. 8 is a circuit diagram illustrating the structure of a unit circuit according to a first modification.

FIG. 8 illustrates a unit circuit U1. In the unit circuit U1, different signals are supplied to the gate of each of the transistors Tr2 and Tr3. In this example, a second compensation control signal GINI2[i] is supplied to the third control line 123, and a first compensation control signal GINI1[i] is supplied to a fifth control line 125. The operation of the unit circuit U1 is substantially the same as in the above-described embodiment in the initialization period P0, compensation period P1, data writing period P2, and driving period P3. As the first compensation control signal GINI1[i] and second compensation control signal GINI2[i], the compensation control signal GINI[i] described above is supplied (see FIG. 3).

Before shipping of the electronic device D, various inspections are performed. One of the inspections is to inspect a short circuit of each of the first capacitive element C1 and the third capacitive element C3. In an inspection term, the scan signal GWRT[i], the first compensation control signal GINI1[i], and the initialization signal GPRE[i] are set at a high level, whereas the light-emission control signal GEL[i] and the second compensation control signal GINI2[i] are set at a low level. This causes the transistors Tr1, Tr3, and Tr4 to be in the on state. If a short circuit occurs between the electrodes Ea1 and Ea2 of the first capacitive element C1, the potential of the data line 14 is equal to the high power supply potential Ve1. If a short circuit occurs between the electrodes Ec1 and Ec2 of the third capacitive element C3, the potential of the data line 14 is equal to the initialization potential VST. As a result, measuring the potential of the data line 14 can detect a short circuit of each of the first capacitive element C1 and the third capacitive element C3. Therefore, according to the unit circuits U1, the inspection can be readily performed.

(2) Second Modification

Figure 9:
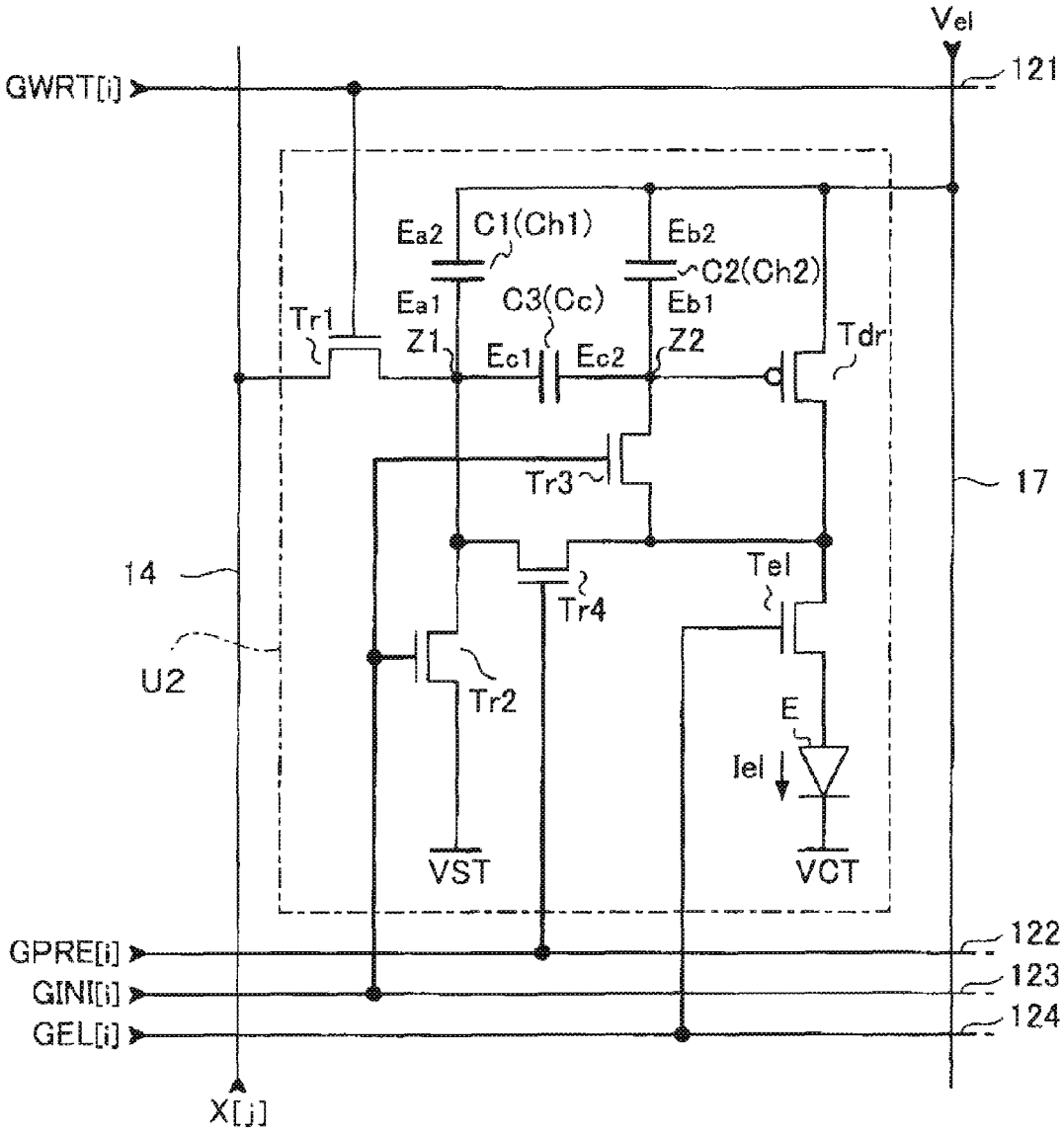
FIG. 9 is a circuit diagram illustrating the structure of a unit circuit according to a second modification.

FIG. 9 illustrates a unit circuit U2. The unit circuit U2 is substantially the same as the unit circuit U illustrated in FIG. 2 according to the embodiment, with the exception that the transistor Tr2 is disposed between a power-supply line that supplies the initialization potential VST and a first input terminal of the transistor Tr4. In the unit circuit U2, a supply of substantially the same signals as in the embodiment described above to the first control line 121 to the fourth control line 124 can cause the third capacitive element C3 to discharge charges stored therein in the initialization period P0, cause the second capacitive element C2 to hold the threshold voltage Vth in the compensation period P1, and cause the third capacitive element C3 to operate as a coupling capacitance and a potential corresponding to a data potential to be applied to the gate of the drive transistor Tdr and held thereby In the data writing period P2. In addition, it causes a drive current Ie1 corresponding to a compensated threshold voltage Vth to be supplied to the electro-optical element E in the driving period P3.

(3) Third Modification

Figure 10:
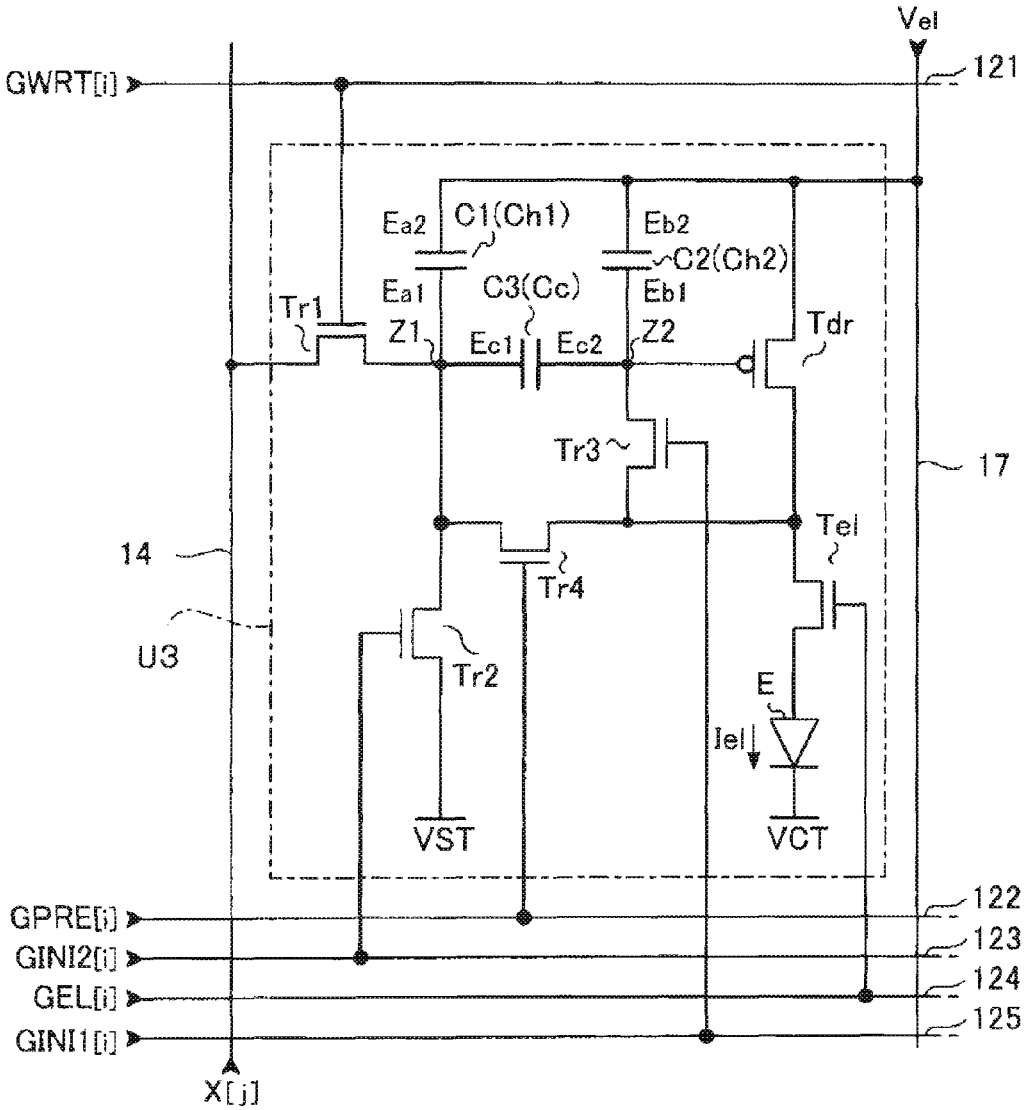
FIG. 10 is a circuit diagram illustrating the structure of a unit circuit according to a third modification.

FIG. 10 illustrates a unit circuit U3. In the unit circuit U3, different signals are supplied to the gate of each of the transistors Tr2 and Tr3. In this example, the second compensation control signal GINI2[i] is supplied to the third control line 123, and the first compensation control signal GINI1[i] is supplied to the fifth control line 125. The operation of the unit circuit U3 is substantially the same as in the above-described embodiment in the initialization period P0, compensation period P1, data writing period P2, and driving period P3. As the first compensation control signal GINI1[i] and second compensation control signal GINI2[i], the compensation control signal GINI[i] described above is supplied (see FIG. 3).

In an inspection term, first, the scan signal GWRT[i] is set at a high level, whereas the light-emission control signal GEL[i], the first compensation control signal GINI1[i], the second compensation control signal GINI2[i], and the initialization signal GPRE[i] are set at a low level. This causes the transistor Tr1 to be in the on state and the transistors Tr2, Tr3, and Tr4 to be in the off state. If a short circuit occurs between the electrodes Ea1 and Ea2 of the first capacitive element C1, the potential of the data line 14 is equal to the high power supply potential Ve1. As a result, measuring the potential of the data line 14 can detect a short circuit of the first capacitive element C1.

Next, a short circuit for the third capacitive element C3 is inspected. First, the scan signal GWRT[i] and the light-emission control signal GEL[i] are set at a low level, whereas the first compensation control signal GINI1[i], the second compensation control signal GINI2[i], and the initialization signal GPRE[i] are set at a high level. This causes the transistor Tr1 and the light-emission control transistor Te1 to be in the off state and the transistors Tr2, Tr3, and Tr4 to be in the on state. At this time, the potential of the electrodes Ea1 and Ea2 is equal to the initialization potential VST.

Second, the scan signal GWRT[i] and the first compensation control signal GINI1[i] are set at a high level, whereas the light-emission control signal GEL[i], the second compensation control signal GINI2[i], and the initialization signal GPRE[i] are set at a low level. This causes the transistors Tr1 and Tr3 to be in the on state and the light-emission control transistor Te1 and the transistors Tr2 and Tr4 to be in the off state. If a short circuit occurs in the third capacitive element C3, the potential of the electrode Ec1 converges to a value of "Ve1−Vth"; if a short circuit does not occur in the third capacitive element C3, the potential of the electrode Ec1 is equal to the initialization potential VST. As a result, measuring the potential of the data line 14 can detect a short circuit of the first capacitive element C1.

Each of the embodiment and modifications can be variously modified. Specific examples of such variations will be described below. The variations described below can be combined as appropriate.

A specific structure of the unit circuit U is not limited to the embodiment and modifications described above. For example, the conductivity type of each transistor in the unit circuit U can be changed as appropriate. The light-emission control transistor Te1 can be omitted as appropriate.

In the embodiment described above, an OLED element is used as the electro-optical element E by way of example. An electro-optical element (driven element) used in an electronic device according to an exemplary embodiment is not limited to the OLED element. For example, instead of the OLED element, various light emitting elements, such as an inorganic EL element, a field emission (FE) element, a surface-conduction electron-emitter (SE) element, a ballistic electron surface-emitting (BS) element, and a light emitting diode (LED) element, and various other electro-optical elements, such as a liquid crystal element, an electrophoretic element, and electrochromic element, can be used. Embodiments of the invention are also applicable to a sensing device, such as a biochip.

3. Applications

Figure 11:
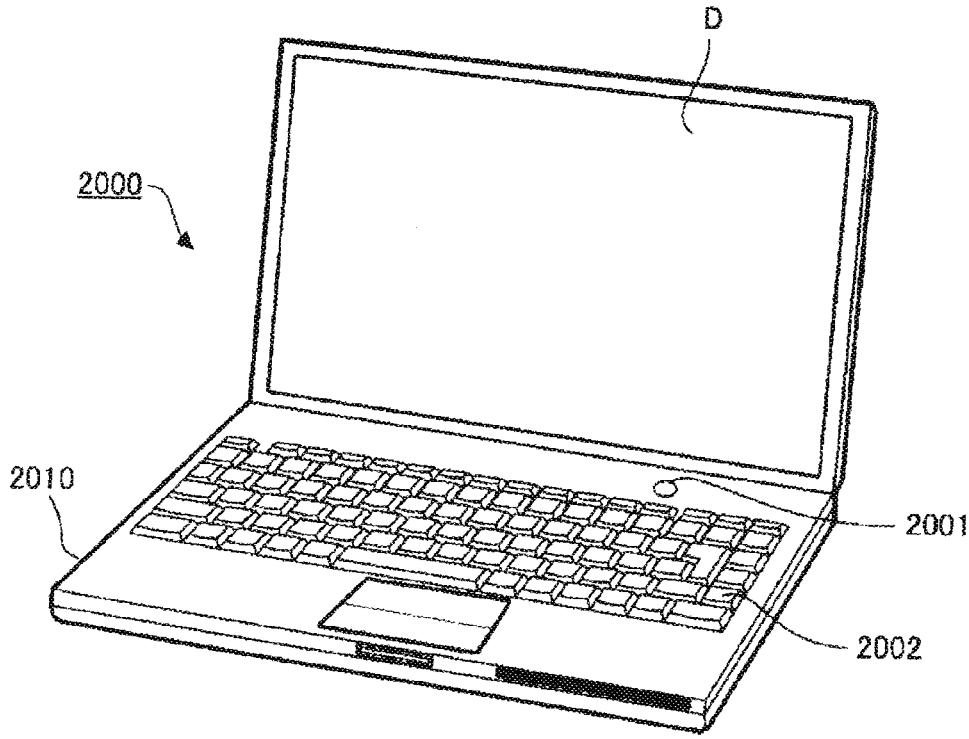
FIG. 11 is a perspective view illustrating a specific form of an electronic apparatus according to an exemplary embodiment.
Figure 12:
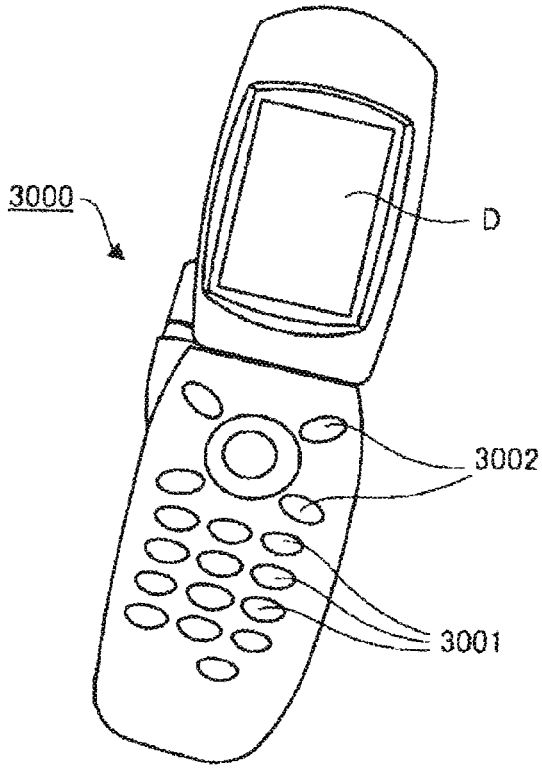
FIG. 12 is a perspective view illustrating another specific form of an electronic apparatus according to an exemplary embodiment.
Figure 13:
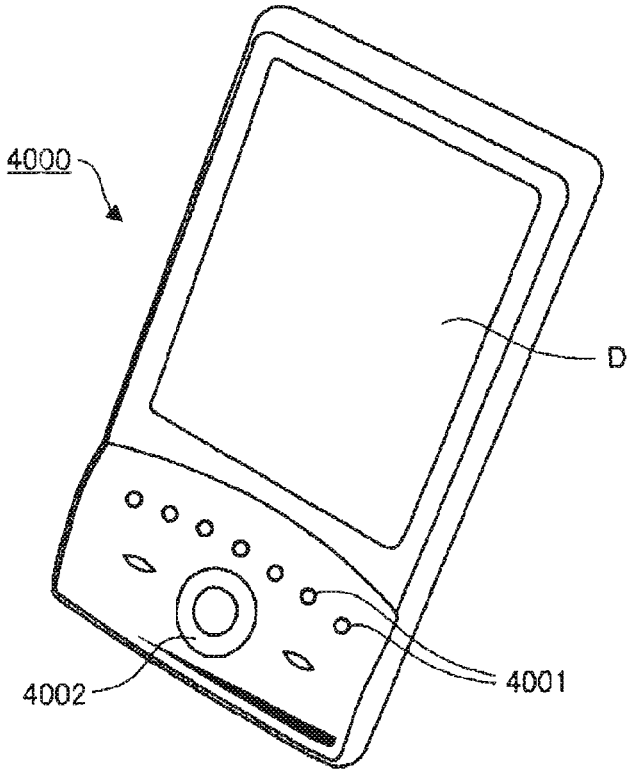
FIG. 13 is a perspective view illustrating still another specific form of an electronic apparatus according to an exemplary embodiment.

An electronic apparatus that uses an electronic device (electro-optical device) according to an exemplary embodiment. FIGS. 11 to 13 illustrate applications each using an electronic device D according to at least one of the embodiment and modifications described above.

FIG. 11 is a perspective view illustrating the structure of a mobile personal computer that uses an electronic device D according to at least one of the embodiment and modifications described above. A personal computer 2000 includes the electronic device D capable of displaying various images and a main body 2010 provided with a power switch 2001 and a keyboard 2002. The electronic device D uses an OLED element as the electro-optical element E. Therefore, the electronic device D can display an easy-to-see screen with a wide viewing angle.

FIG. 12 illustrates the structure of a cellular phone that uses an electronic device D according to at least one of the embodiment and modifications. A cellular phone 3000 includes a plurality of operation buttons 3001, scroll buttons 3002, and the electronic device D capable of displaying various images. Operating the scroll buttons 3002 scrolls a screen displayed on the electronic device D.

FIG. 13 illustrates the structure of a personal digital assistant (PDA) that uses an electronic device D according to at least one of the embodiment and modifications described above. A PDA terminal 4000 includes a plurality of operation buttons 4001, a power switch 4002, and the electronic device D capable of displaying various images. Operating the power switch 4002 causes the electronic device D to display various kinds of information, such as addresses and schedules.

Examples of an electronic apparatus that uses an electronic device according to at least one of embodiment and modifications of the embodiments include, in addition to apparatuses illustrated in FIGS. 11 to 13, a digital still camera, a television, a video camera, a cam coder, a car navigation system, a pager, an electronic organizer, electronic paper, an electronic calculator, a word processor, a work station, a videophone, a point-of-sale (POS) terminal, a printer, a scanner, a copier, a video player, and a device having a touch panel. Applications of an electronic device according to embodiments of the invention are not limited to image displaying. For example, the electronic device according to the invention is applicable to a writing head that exposes a photosensitive member in accordance with an image to be formed on a recording medium (e.g., a sheet of paper) for use in an image forming apparatus, such as an optical writing printer and electronic copier.

What is claimed is:

1. A unit circuit comprising:

an electro-optical element that emits an amount of light in accordance with a magnitude of a drive current;

a first capacitive element that includes a first electrode and a second electrode, the first electrode being electrically connected to a first node, the second electrode being capable of receiving a fixed potential;

a second capacitive element that includes a third electrode and a fourth electrode, the third electrode electrically connected to a second node, the fourth electrode being capable of receiving the fixed potential;

a third capacitive element that includes a fifth electrode and a sixth electrode, the fifth electrode being electrically connected to the first node, the sixth electrode being electrically connected to the second node;

a drive transistor that includes a gate, a source, and a drain and that outputs the drive current in a driving period, the gate being electrically connected to the second node;

a first switching element that, in a data writing period, is in an on state and supplies to the first node a data potential supplied via a data line;

an initialization unit connected to both the first node and the second node and supplying a fixed initialization voltage to the fifth electrode and the sixth electrode of the third capacitive element during an initialization period; and a compensation unit that electrically connects the gate and the drain of the drive transistor together in a compensation period, the fixed initialization voltage being set to a voltage less than a difference between the fixed potential and a threshold voltage of the drive transistor.

2. The unit circuit according to claim 1, during the initialization period the initialization unit (1) causing the third capacitive element to discharge charges stored therein and (2) supplying an initialization potential to the second node.

3. The unit circuit according to claim 2, the initialization unit comprising:

a second switching element disposed between the first node and a potential line that supplies the initialization potential;

a third switching element that has a first input terminal and a second input terminal, the first input terminal being electrically connected to the second node; and a fourth switching element disposed between the potential line and the second input terminal of the third switching element.

4. The unit circuit according to claim 2, wherein the initialization unit includes:

a second switching element that has a first input terminal and a second input terminal, the first input terminal being electrically connected to a potential line that supplies the initialization potential;

a third switching element that has a first input terminal and a second input terminal, the first input terminal being electrically connected to the second node; and a fourth switching element disposed between the second input terminal of the second switching element and the second input terminal of the third switching element.

5. The unit circuit according to claim 3, wherein the second input terminal of the third switching element in the initialization unit is electrically connected to the drain of the drive transistor, and, in the compensation period, the third switching element is in an on state and also functions as the compensation unit.

6. The unit circuit according to claim 1, further comprising a power supply line that supplies a power supply potential, the power supply line being electrically connected to the source of the drive transistor, the second electrode of the first capacitive element, and the fourth electrode of the second capacitive element.

7. The unit circuit according to claim 1, further comprising:

a light-emission control switching element disposed on an electrical path between the drive transistor and the electro-optical element, the light-emission control switching element being in an on state during the driving period and being in an off state during the initialization period, the compensation period, and the data writing period.

8. The unit circuit according to claim 1, wherein the first capacitive element, the second capacitive element, and the third capacitive element have capacitance values that are substantially the same.

9. An electro-optical device comprising:

a plurality of unit circuits, each unit circuit of the plurality of unit circuits including:

an electro-optical element that emits an amount of light in accordance with a magnitude of a drive current;

a first capacitive element that includes a first electrode and a second electrode, the first electrode being electrically connected to a first node, the second electrode being capable of receiving a fixed potential;

a second capacitive element that includes a third electrode and a fourth electrode, the third electrode being electrically connected to a second node, the fourth electrode being capable of receiving the fixed potential;

a third capacitive element that includes a fifth electrode and a sixth electrode, the fifth electrode being electrically connected to the first node, the sixth electrode being electrically connected to the second node;

a drive transistor that includes a gate, a source, and a drain and that outputs the drive current in a driving period, the gate being electrically connected to the second node;

a first switching element that, in a data writing period, is in an on state and supplies to the first node a data potential supplied via a data line;

an initialization unit connected to both the first node and the second node and supplying a fixed initialization voltage to the fifth electrode and the sixth electrode of the third capacitive element during an initialization period; and a compensation unit that electrically connects the gate and the drain of the drive transistor together in a compensation period, the fixed initialization voltage being set to a voltage less than a difference between the fixed potential and a threshold voltage of the drive transistor.

10. An electronic apparatus comprising a housing, and the electro-optical device according to claim 9 accommodated by the housing.

11. An electronic apparatus comprising:

an electrooptical element;

a capacitor network with a first terminal and a second terminal, including:

a first capacitive element;

a second capacitive element; and a third capacitive element, the first, second and third capacitive elements being connected in a pi configuration;

a drive transistor including a gate and a drain, the gate being electrically connected to the second terminal of the capacitor network and the drain being electrically connected to the electrooptical element, the drive transistor outputting a drive current to the electrooptical element during a driving period;

a first switching element that is in an on state during a data writing period and supplies a voltage to the first terminal of the capacitor network;

an initialization unit connected to the first and second terminals, the initialization unit supplying a fixed initialization voltage to the first and the second terminals during an initialization period; and a compensation unit that connects the gate of the drive transistor to the drain of the drive transistor during a compensation period, the fixed initialization voltage being set to a voltage less than a difference between a power supply voltage and a threshold voltage of the drive transistor.

* * * * *